US005478415A

United States Patent [19]

Massad et al.

[11] Patent Number: 5,478,415

[45] Date of Patent: Dec. 26, 1995

[54] PROCESS AND COMPOSITION FOR SEALING ANODIZED ALUMINUM SURFACES

[75] Inventors: Suhail K. Massad; Mores A. Basaly, both of Marietta, Ga.; Louis F. Agudelo, Santa Anita, Mexico

[73] Assignee: Novamax Technology Holdings, Inc., Mississagua, Canada

[21] Appl. No.: 344,177

[22] Filed: Nov. 23, 1998

Related U.S. Application Data

[62] Division of Ser. No. 150,489, Nov. 10, 1993, Pat. No. 5,411,607.

[51] Int. Cl.[6] ..... C25D 11/18

[52] U.S. Cl. ..... 148/272

[58] Field of Search ..... 148/274, 272

[56] References Cited

U.S. PATENT DOCUMENTS

| | | | |
|---|---|---|---|
| 3,374,155 | 3/1968 | Weber | 205/223 |
| 3,849,264 | 11/1974 | Weber et al. | 205/50 |
| 4,063,969 | 12/1977 | Howell, Jr. | 148/274 |
| 4,098,194 | 7/1978 | Miller et al. | 102/105 |
| 4,225,398 | 9/1980 | Hasegawa et al. | 204/33 |
| 4,549,910 | 10/1985 | Barba | 148/6.27 |
| 4,786,336 | 11/1988 | Schoener et al. | 148/6.27 |
| 4,939,001 | 6/1990 | Brodalla et al. | 427/419.2 |
| 4,988,396 | 1/1991 | Bibber | 148/269 |
| 5,192,374 | 3/1993 | Kindler | 148/272 |
| 5,362,317 | 11/1994 | Patel et al. | 106/287.23 |
| 5,374,455 | 12/1994 | Patel et al. | 427/435 |

FOREIGN PATENT DOCUMENTS

| | | |
|---|---|---|
| 0347663 | 6/1989 | European Pat. Off. . |
| 49-23086 | 6/1974 | Japan . |
| 52-6258 | 1/1977 | Japan . |
| 52-155143 | 12/1977 | Japan . |
| 56-27476 | 3/1981 | Japan . |
| 59-52719 | 3/1984 | Japan . |
| 59-175795 | 10/1984 | Japan . |
| 215192 | 1/1990 | Japan . |
| 273992 | 3/1990 | Japan . |
| 3111593 | 5/1991 | Japan . |
| 2126215 | 8/1983 | United Kingdom . |
| 2254622 | 4/1992 | United Kingdom . |

OTHER PUBLICATIONS

Fluka Chemika–BioChemika Catalogue Fluka Chemie AG (1993), p. 806.

*Primary Examiner*—John Niebling
*Assistant Examiner*—Brendan Mee
*Attorney, Agent, or Firm*—Reising, Ethington, Barnard & Perry

[57] ABSTRACT

This invention relates to a process and composition for sealing anodically oxidized aluminum surfaces, the composition having an effective amount of a source of alkali metal ions especially lithium ions. The process of the invention involves contacting an anodically oxidized aluminum surface with the aqueous sealing solution of the invention.

6 Claims, No Drawings

PROCESS AND COMPOSITION FOR SEALING ANODIZED ALUMINUM SURFACES

This is a divisional of application Ser. No. 08/150,489, filed on Nov. 10, 1993, now U.S. Pat. No. 5,411,607.

FIELD OF THE INVENTION

This invention relates to a process for sealing anodically oxidized aluminum and aluminum alloy surfaces, so as to increase the resistance of the anodic oxide film to external corrosive agents, and to a composition for use in the process of the invention. More specifically, the invention provides an aqueous sealing composition substantially-free of environmentally sensitive heavy metals.

BACKGROUND OF THE INVENTION

Articles of aluminum or an aluminum alloy are typically subjected to an anodic oxidation process to improve the hardness and corrosion resistance of the surface of the article. As used herein, the term aluminum includes pure or substantially pure aluminum as well as alloys of aluminum containing, in general, at least about 50% by weight of aluminum. Examples of other metals which may be present in such aluminum alloys are silicon, bismuth, copper, nickel, zinc, chromium, lead, iron, titanium, manganese, and the like. The anodic oxidation of an aluminum surface results in the formation of a uniform, translucent, highly porous aluminum oxide film. The anodic oxide film can also serve an aesthetic or decorative function and may be clear, inorganically dyed, or electrolytically colored.

Generally, these anodic aluminum oxide films result from the passage of a direct electric current through an acidic electrolyte solution at temperatures ranging from 32° F. to 90° F. Typically, the acidic electrolyte solution will employ sulfuric acid at concentrations from 140 to 200 grams per liter g/L.

Anodic oxidation of aluminum is intended to provide a protective coating or film of aluminum oxide on the aluminum surface. Although this anodic oxide layer is more resistant to corrosion than the untreated aluminum surface, the porous structure of the aluminum oxide layer ultimately renders it vulnerable to corrosion and degradation, particularly to that caused by external chemical agents. As a result, anodized aluminum oxide films or surfaces are commonly subjected to a process known as sealing. It is currently theorized that the sealing process closes or fills the pores via hydration and/or precipation of one or more compounds. Aluminum articles treated in such a manner are generally usable in a wide variety of end use applications, even those employing severe environmental conditions.

High quality sealed anodic aluminum oxide films should exhibit superior resistance to corrosion and degradation caused by external chemical agents.

Prior art sealing processes can generally be divided into three categories: (a) hydrothermal sealing processes, (b) mid-temperature sealing processes, and (c) low temperature sealing processes.

Hydrothermal sealing processes employ steam or boiling water to seal the anodic oxide coating. This process involves the hydration of the oxide coating which results in the constriction of the surface pores. Although good quality sealed films are generally obtained, the disadvantage of this process is the extremely high energy cost associated with its operation.

Mid-temperature sealing processes operate at temperatures between 170° to 200° F. They generally employ aqueous solutions of heavy metal salts such as nickel or cobalt. Mid-temperature sealing processes enjoy a significant savings in energy consumption as compared to hydrothermal sealing processes, but present significant waste disposal problems in view of the presence of heavy metals. Such solutions often require expensive pretreatments prior to disposal.

Low temperature sealing processes also suffer from the presence of heavy metals. Such processes typically employ nickel salts such as nickel fluoride and operate at temperatures of about 90° F. In addition to the waste disposal problems, low temperature sealing processes suffer from the disadvantage of producing a sealed anodic film having a very low crazing temperature.

Thus, the prior art has failed to provide a process or composition for use in sealing anodized aluminum oxide films which provide the economic advantages of the mid-temperature and low temperature sealing processes but retain the overall film quality and waste disposal advantages of the hydrothermal sealing processes. A review of representative prior art patents addressing this problem illustrates the lack of a satisfactory solution.

For example, U.S. Pat. No. 4,939,001 to Brodalla et al. discloses the use of sealing solutions containing phosphonic acid and the alkali metal salts and alkanolamine salts of those acids. It also discloses the use of alkali metal acetates and alkali metal hydroxides as buffering agents. Although this sealing composition does not appear to contain heavy metals, it is disadvantageous because careful control of the phosphonic acid concentrations are required. At increased concentrations, phosphorus containing compounds inhibit sealing. Also, as disclosed by the working examples, high application temperatures above 200° F., (i.e., from 205° to 208° F.), are required for desirable surface characteristics. Thus, the disclosed process and composition are disadvantageous due to operating costs and quality control requirements.

British Patent No. GB 2,254,622 A discloses an aqueous sealant composition comprising at least one alkaline earth metal salt and a particular anti-smut compound. Per the teachings of this patent application, both compounds are required to achieve high quality sealed surfaces.

Prior art sealing processes employing the use of alkali metal silicates are particularly disadvantageous because such alkali metal silicate compositions must be used at low concentrations. At concentrations greater than about 0.05 g/L, such silicates can precipitate out and render the sealing composition unusable. In addition, it has been found that the soluable silicates can inhibit the sealing process itself.

Thus, it is an object of the invention to provide a process and composition for sealing anodized aluminum articles or surfaces which has relatively low energy costs, is environmentally friendly and provides a sealed anodic aluminum oxide film of high quality.

It is a further object of the invention to provide a process and composition for providing high quality sealed aluminum oxide films which employs an effective amount of a source of lithium ions.

Finally, it is a further object of the invention to provide a process and composition for sealing anodized aluminum oxide films which employs an effective amount of a source of alkali metal ions, wherein the aqueous sealing solution is substantially free of compounds containing an element selected from the group consisting of the heavy metals, silicon, and phosphorus.

SUMMARY OF THE INVENTION

The present invention generally provides a process and composition for sealing anodically oxidized aluminum surfaces wherein the composition of the invention is an aqueous sealing solution having an effective amount of a source of lithium ions. An effective amount of lithium ions is from 0.01 g/L to 50.0 g/L. The composition of the invention may be supplied as a concentrate having from 1.0 g/L up to 50.0 g/L of lithium ions. The concentrate may be diluted to provide sealing solutions or baths having from 0.01 g/L to 5.0 g/L lithium ions.

More particularly, the invention pertains to an aqueous sealing solution having an effective amount of a source of alkali metal ions, wherein the aqueous sealing solution is substantially free of compounds containing elements selected from the group consisting of the heavy metals, silicon, or phosphorus.

The process of the invention generally involves contacting an anodically oxidized aluminum surface with the compositions of the invention.

BEST MODE FOR CARRYING OUT THE INVENTION

The present invention generally addresses the deficiencies of the prior art by providing a process for sealing anodically oxidized aluminum surfaces which employs a composition containing an effective amount of a source of alkali metal ions and most preferably, a source of lithium ions. It has been unexpectedly found that relatively small concentrations of lithium ions produce high quality sealed aluminum oxide surfaces.

Anodized aluminum surfaces suitable for sealing according to the present invention will generally be those obtainable by known anodic oxidation processes. For example, suitable anodized aluminum surfaces will generally be those resulting from the process of passing a DC electric current through an acidic electrolyte solution with the aluminum surface arranged as the anode and a cathode arranged as the counter electrode. Suitable acidic electrolyte solutions are those containing sulfuric acid, oxalic acid or sulfamic acid. It will be appreciated that prior to submersion of the aluminum article in the electrolyte solution, the article preferably will be degreased and washed in a conventional manner. Although the parameters of the preferred anodizing process are set forth in the working examples, those skilled in the art will appreciate that it is not essential to the practice of the invention that the anodizing process be so limited.

Decorative anodized aluminum surfaces such as those which have been colored either electrolytically or with the use of organic and/or inorganic dyes may also be sealed with the use of the present invention. The anodized aluminum oxide films to be sealed will be found on aluminum articles having a wide variety of shapes and configurations and will result from numerous manufacturing and processing means. Illustrative examples of suitable aluminum articles are plates, pipes, rods, extruded bars with irregular or regular cross-sections, and articles formed by deep drawing and pressing.

The composition of the instant invention broadly comprises an aqueous sealing solution having an effective amount of a source of alkali metal ions. The term alkali metals as used herein refers to group 1A of the Periodic Table, i.e. lithium, sodium, potassium, rubidium, cesium, and francium. Preferably, the source of alkali metal ions will be a source of an alkali metal selected from the group consisting of lithium, sodium, potassium, and mixtures thereof. Most preferably, the source of alkali metal ions will be a source of lithium ions.

The source of alkali metal ions may be combined with generally available tap water provided that such water is substantially phosphate and silicate free. Most preferably, the source of alkali metal ion will be combined with demineralized water. Demineralized water is commercially available and may be defined as water from which all ionic constituents have been removed.

An effective amount of the source of alkali metal ion is an amount, which upon the addition of the source to water, results in a concentration of total alkali metal ion of from 0.01 g/L to 50.0 Preferably, an effective amount of the source of alkali metal ion will result in a total alkali metal ion concentration of from 0.3 g/L to 10.0 g/L and most preferably 0.3 g/L to 5.0 g/L. The composition of the invention may be supplied as a concentrate having from 1.0 g/L up to 50.0 g/L of lithium ions. The concentrate may be diluted to provide sealing solutions or baths having from 0.01 g/L to 5.0 lithium ions.

Suitable sources of the alkali metal ion are those alkali metal containing compounds which, upon addition to an aqueous solution, result in the disassociation of the alkali metal ion. Particularly suitable for use herein are alkali metal hydroxides and alkali metal salts. It is within the scope of this invention that the source of the alkali metal ion may be a single metal hydroxide or metal salt or may be a combination of different metal hydroxides or metal salts or a combination of metal hydroxides and metal salts. Illustrative examples of suitable sources of alkali metal ion are the alkali metal acetates, alkali metal nitrates, alkali metal chlorides, alkali metal carbonates, alkali metal bicarbonates, alkali metal oxides, alkali metal hydroxides, alkali metal bromates, and alkali metal oxalates. Alkali metal acetates and those compounds which are alkali metal acetate precursors are most preferred. It will be appreciated that alkali metal ion precursors are compounds such as alkali metal hydroxides and alkali metal oxides.

In general, the aqueous sealing composition of the instant invention will have an operating pH ranging from 5.0 to 8.0, with a most preferred pH range of 5.5 to 6.5. The wide pH range is a result of the greater solubility of alkali metals at such pH values as compared to heavy metals such as nickel. Those skilled in the art will appreciate that buffering salts or the precursor reactants of such buffering salts may be added to achieve the desired pH. With some alkali metal hydroxides and salts, the pH of the sealing solution must be adjusted with an acid. A preferred acid is acetic acid. Those skilled in the art will appreciate that the most preferred alkali metal acetates will result. In the most preferred embodiment, the presence of lithium acetate and acetic acid in solution provide the buffering composition. PH adjustments may be made as needed with the use of acetic acid or ammonium hydroxide.

Although a wide number of alkali metal compounds may be used as the source of the alkali metal ion, certain counter ions are believed to interfere or inhibit the sealing process. Particularly non-suitable compounds are alkali metal phosphates and alkali metal silicates. When phosphates interact with unsealed aluminum oxide films, such surfaces become very difficult to seal. In particular, it has been found that phosphate concentrations of less than 20 ppm in a sealing bath can degrade sealing quality. Similar effects have been observed with silicate concentrations greater than 40 ppm.

The aqueous sealing composition of the instant invention may further contain sealing additives which enhance the quality of the sealed anodic aluminum surface and which prevent the formation of smut or bloom often encountered in sealing processes.

Smut or bloom as used herein is intended to describe the deposition of hydrated aluminum oxide crystals on the surface of the anodic aluminum oxide film. Those skilled in the art will appreciate that such smut or bloom greatly impairs the decorative or aesthetic appeal of anodized aluminum. The hydrated aluminum oxide is easily degraded by light abrasion or touching and is particularly vulnerable to contact with human hands. Smut also interferes with attempts to bond such sealed anodized aluminum surfaces. Chemical and mechanical desmuting after-treatments introduce undesirable expense and may themselves adversely affect the overall quality of the sealed anodized aluminum film.

Thus, although the sealant composition of the instant invention may also contain conventional additives such as wetting agents, buffering agents, defoaming agents, etc. most preferably, the composition will contain a sealant additive selected from the general class of organic smut inhibitors. An illustrative example of a most preferred compound is Dowfax 2A1, commercially available from Dow Chemicals of Midland, Mich.

In general, preferred organic smut inhibitors may have the following structure:

I

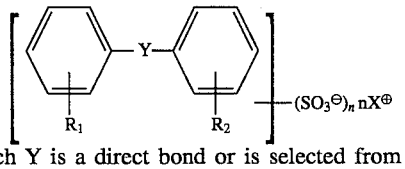

in which Y is a direct bond or is selected from the group consisting of:

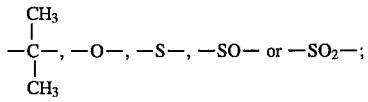

and each of $R_1$ and $R_2$ are independently hydrogen or $C_5$–$C_{25}$ alkyl, with the proviso that $R_1$ and $R_2$ are not both hydrogen; n is an integer from 1 to 4 inclusive, and $X^{\oplus}$ is a counterion, such as $H^{\oplus}$ or an alkali metal ion.

In general, such sealant additives or water soluble organic surfactants will generally be used in a concentration range of from 0 g/L to 10 g/L. Concentrations of from 0.5 to 3.0 g/L are most preferred.

As will be discussed below, it has been found that the use of the aqueous sealing composition of the instant invention produces sealed anodized aluminum surfaces of superior quality. An advantage of the instant sealing solution containing alkali metal ions in general, and lithium in particular, is the greater solubility of the alkali metal ions over a wider pH range. The alkali metals in general and lithium in particular are believed to form insoluble alkali metal aluminum oxide complexes. It is postulated that these complexes form on the surface of the anodic aluminum oxide film and on the inside of the individual pores which are pervasive in an unsealed anodized aluminum oxide film. Concurrent thermal hydration of the anodic layer produces a passivated layer having stricted pores. In the case of lithium, it is believed that deeper penetration inside the aluminum oxide structure is possible as a result of its small ionic size.

The process of the instant invention comprises contacting an anodically oxidized aluminum surface with the aqueous sealing composition disclosed herein. Aluminum work pieces as disclosed above having anodized aluminum oxide films are preferably contacted with the aqueous sealing composition by immersion of the work piece in the solution at a temperature and for a time as disclosed herein. High quality sealed anodized aluminum surfaces may be obtained when the composition of the instant invention is generally maintained at a temperature in the range of 170° F. to less than 200°F. during the period of immersion. While those skilled in the art will appreciate that while higher temperature are permissible, economic considerations require high quality seals at temperatures less than 200° F. Most preferably, the composition will be maintained at a temperature between 180° F. to 190° F. The most preferred temperatures are between 185° to 190° F.

It will be appreciated that the time of immersion or contact of the anodized aluminum surface or article with the aqueous sealing composition is a function of the thickness of the anodized aluminum oxide film. In general, the article will remain in contact with the sealing composition for a minimum of three minutes with an additional one minute for every 0.1 mil of anodized aluminum oxide film.

The practice of the invention may be further appreciated from the following, non-limiting operating examples.

In the following examples and those following, commercially available type 6063 aluminum panels were subjected to the following cleaning and anodization processes. Test panels were 3.0×3.5 inches. Test panels were initially cleaned by immersion in an aqueous solution containing 50.0 g/L Novaclean 120 at a temperature of 160° F. for approximately five minutes. Novaclean 120 is a proprietary cleaner commercially available from Novamax Technologies (U.S.) Inc. of Atlanta, Ga. After rinsing the degreased panels with tap water at room temperature, they were etched at 150° F. for approximately five minutes with a solution containing 50.0 g/L NaOH with 2.0% by volume EA1000. EA1000 is a proprietary etch additive commercially available from Novamax Technologies (U.S.) Inc. of Atlanta, Ga. After rinsing with tap water at room temperature, the test panels were desmuted by immersion in Novox 300 at a temperature of approximately 70° F. for one minute. Novox 300 is a two-component mixture made of 4 ounces/per gallon of Novox 300A and 5% by volume Novox 300B. Both Novox 300A and Novox 300B are proprietary desmuting products commercially available from Novamax Technologies (U.S.) Inc. of Atlanta, Ga. The panels were subsequently rinsed with tap water at room temperature.

The cleaned test panels were anodized under the following conditions. The anodizing bath contained 180 g/L of sulfuric acid and 3% SC-700. SC-700 is a hardcoat additive commercially available from Novamax Technologies (U.S.) Inc of Atlanta, Ga. It will be appreciated that SC-700 is not necessary for the successful operation of the instant invention. The temperature of the bath was 70° F. and the current density approximately 18 ASF. The test panels were immersed in the bath for approximately 29 minutes to achieve an oxide layer having a thickness of from 0.7 to 0.8 mil.

EXAMPLE 1

The anodized aluminum panels prepared according to the foregoing procedures were sealed by immersion in three different sealing compositions prepared according to the instant invention. Compositions A, B and C varied with respect to the lithium acetate concentration and were maintained at a temperature of 190° F. Each composition contained 1.0 g/L of Dowfax 2A1. Test panels were immersed in the 190° sealing solutions for 10 minutes.

The quality of the sealed aluminum oxide surface was determined by the acid disolution test (ADT) according to ASTM B-368-8. The results are given below:

| COMPOSITION | LITHIUM ACETATE g/L | ADT mg/in$^2$ |
|---|---|---|
| A | 3.32 | 0.52 |
| B | 4.75 | 0.36 |
| C | 7.40 | 0.25 |

It can be seen that even with Composition A, having the lowest concentration of lithium acetate, superior ADT results are achieved. Those skilled in the art will appreciate that ADT values of greater than 2.6 are considered failures with optimum ADT values being as low as possible.

EXAMPLE 2

The effect of temperature upon seal quality was evaluated. Test panels prepared as indicated above were immersed in four samples of a sealing composition of the instant invention maintained at four different temperatures. The sealing solution contained 4.75 g/L lithium acetate. Each test panel was immersed in the sealing solution for a period of 10 minutes. Results are given below.

| TEST | SEAL TEMP °F. | ADT mg/in$^2$ |
|---|---|---|
| D | 160 | 12.3 |
| E | 170 | 4.9 |
| F | 180 | 0.36 |
| G | 190 | 0.25 |

It can be observed that optimum seal quality is achieved at temperatures between 180° to 190° F.

EXAMPLE 3

The effect of alkali metal ion composition and concentration was evaluated. Test panels prepared according to the foregoing procedures were immersed in six different sealing solutions for 11 minutes, (one panel per solution). All sealing solutions were maintained at 190° F. The sealing additive was Dowfax 2A1. The results are given below:

| TEST | METAL USED INSEALING SOLUTION | METAL CONC. g/L | SEALING ADDITIVE g/L | ADT mg/in$^2$ |
|---|---|---|---|---|
| H | Lithium | 0.5 | 3.2 | 0.25 |
| I | Sodium | 1.6 | 3.2 | 1.32 |
| J | Potassium | 2.8 | 3.2 | 1.62 |
| K | Lithium | 0.5 | 1.6 | 0.37 |
| L | Sodium | 1.6 | 1.6 | 2.26 |

-continued

| TEST | METAL USED INSEALING SOLUTION | METAL CONC. g/L | SEALING ADDITIVE g/L | ADT mg/in$^2$ |
|---|---|---|---|---|
| M | Potassium | 2.8 | 1.6 | 2.43 |

It can be seen that in all cases passing results were obtained. However, the results illustrate that lithium provides superior results in concentrations substantially less than that required for sodium or potassium.

EXAMPLE 4

The effect of adding sodium or potassium ions to a lithium ion containing sealing solution was evaluated. Test panels prepared according to the foregoing procedures were immersed in three different sealing solutions for 11 minutes (one panel per solution). The sealing solutions were maintained at 190° F. and contained 1.6 g/L of Dowfax 2A1.

| TEST | LITHIUM CONC. mg/L | SODIUM CONC. mg/L | POTASSIUM CONC. mg/L | ADT mg/L |
|---|---|---|---|---|
| N | 500 | 0.00 | 0.00 | 0.28 |
| O | 500 | 1000 | 0.00 | 0.29 |
| P | 500 | 0.00 | 1000 | 0.29 |

It will be appreciated that the effect of sodium and potassium upon seal quality is apparently negligible if an effective amount of lithium is present. Even though the sodium and potassium concentrations are approximately twice that of the lithium concentration, the ADT result of the lithium alone (N) is equivalent or better than the mixtures (O & P).

Comparative Example 1

Test panels prepared according to the foregoing procedures were respectively sealed in a nickel based mid-temperature sealing solution and a lithium based mid-temperature sealing solution prepared according to the instant invention.

The characteristics of the two sealing solutions are set forth below:

| | Metal ion conc. | Dowfax 2A1 | pH |
|---|---|---|---|
| Lithium | 500 ppm | 1.0 g/L | 5.8 |
| Nickel | 800 ppm | 1.0 g/L | 5.8 |

Test panels having an anodic oxide coating of from 0.7 to 0.8 mils thick were immersed in sealing solutions maintained at 185° F. for 10 minutes.

The surface of each sealed test surface was subsequently rubbed with a pumice stone for approximately 30 seconds. Subsequent acid dissolution testing showed a failing result, (i.e., greater than 2.6 mg/in$^2$) for the nickel sealed panel and a passing result for the lithium sealed panel. These results indicate that the lithium has penetrated the aluminum oxide layer to form lithium aluminum oxide complexes beneath the aluminum oxide surface.

Comparative Example 2

The effectiveness of a lithium acetate based sealing solution Of the instant invention was evaluated against magnesium acetate and calcium acetate based mid-temperature sealing solutions. The magnesium and calcium solutions (1 & 2) were prepared according to examples 4 and 5 of U.K. Patent No. 254622A. Solution number 3 was prepared according to the instant invention and contained 3.0 g/L lithium acetate. The organic surfactant used in each case was Dowfax 2A1. The parameters of the sealing solutions are set forth below:

| Solution # | Inorganic Salt | Organic Surfactant | pH |
|---|---|---|---|
| 1 | Mg $(CH_3CO_2)_2$ 3.0 g/L | Dowfax 2A1 1.5 g/L | 5.8 |
| 2 | Ca $(CH_3CO_2)_2$ 2.8 g/L | Dowfax 2A1 0.9 g/L | 5.8 |
| 3 | Li $CH_3CO_2.H_2O$ 3.0 g/L | 1.5 g/L | 5.8 |

The test panels utilized for this experiment were type 6063 aluminum alloy (3.0×3.5 inches) and were prepared as indicated above.

Seal quality was evaluated with an ADT test and a modified dye stain test (ASTM B-136-77). The modified dye stain test required that a 40% nitric acid solution be in contact with the sealed surface for approximately two minutes. The surface was subsequently rinsed and contacted with a commercially available blue dye for one to two minutes. The dye used was Aluminum Blue 2LW from North Central Laboratories of Bernamwood, Wis. Permanent incorporation of the dye into the surface indicated a failure. The results are set forth below:

| Solution # | ADT $mg/in^2$ | Modified Dye Stain |
|---|---|---|
| 1 | 1.37 (ave) | Failed |
| 2 | 10.36 (ave) | Failed |
| 3 | 0.68 (ave) | Passed |

While the best modes for carrying out the invention have been described in detail, those familiar with the art to which the invention pertains will recognize alternative designs and embodiments for practicing the invention as defined by the following claims.

We claim:

1. An aqueous composition for sealing anodically oxidized aluminum surfaces, comprising:

an effective sealing amount of a source of lithium ions in a concentration of at least 0.01 g/L which amount is effective to seal the anodically oxidized aluminum surface, and wherein the solution has less than 50 ppm of an element selected from the group consisting of heavy metals, silicon and phosphorous, further comprising a sealing additive that is a water soluble organic surfactant capable of decreasing smut present in an amount from 0.1 g/L to 10 g/L.

2. The composition of claim 1 wherein an effective amount of the source results in a concentration of lithium ions of from 0.01 g/L to 50 g/L.

3. The composition of claim 2 wherein an effective amount of the source results in a concentration of lithium ions of from 0.01 g/L to 10 g/L.

4. The composition of claim 1 having a pH of from 5.0 to 8.0.

5. The aqueous composition of claim 1 wherein the source of lithium ions is a source of an ion selected from the group consisting essentially of acetate ions and acetate ion precursors.

6. The composition of claim 1 wherein the organic smut inhibiting sealing additive is

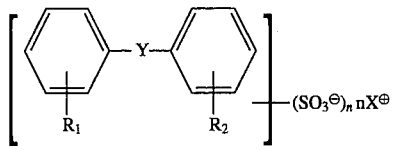

wherein y is a direct bond or is selected from the group consisting of

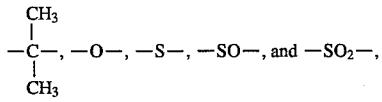

and each of $R_1$ and $R_2$ are independently hydrogen or a linear or branched $C_4$–$C_{25}$ alkyl group wherein $R_1$ and $R_2$ are not both hydrogen; n is an integer from 1 to 4; and $X^+$ is a counterion.

* * * * *